US007918643B2

(12) United States Patent
Weaver

(10) Patent No.: US 7,918,643 B2
(45) Date of Patent: Apr. 5, 2011

(54) SEALING ARRANGEMENT IN A GAS TURBINE ENGINE

(75) Inventor: Kevin J Weaver, North Somerset (GB)

(73) Assignee: Rolls-Royce plc, London (GB)

( * ) Notice: Subject to any disclaimer, the term of this patent is extended or adjusted under 35 U.S.C. 154(b) by 933 days.

(21) Appl. No.: 11/806,814

(22) Filed: Jun. 4, 2007

(65) Prior Publication Data

US 2009/0324394 A1 Dec. 31, 2009

(30) Foreign Application Priority Data

Jun. 7, 2006 (GB) ..... 0611388.0

(51) Int. Cl.
*F04D 29/08* (2006.01)

(52) U.S. Cl. ..... 415/171.1; 415/173.3; 415/173.7; 415/174.2; 277/413; 277/415; 277/421; 277/347; 277/423

(58) Field of Classification Search ..... 415/156, 415/170.1, 171.1, 173.3, 173.7, 174.2, 189, 415/199.5, 209.1, 209.2, 232; 277/413, 415, 277/421, 347, 423
See application file for complete search history.

(56) References Cited

U.S. PATENT DOCUMENTS

| | | | | |
|---|---|---|---|---|
| 3,026,087 | A * | 3/1962 | Welsh | 415/209.2 |
| 5,328,328 | A * | 7/1994 | Charbonnel et al. | 415/173.7 |
| 5,890,874 | A * | 4/1999 | Lambert et al. | 416/193 A |
| 6,514,045 | B1 * | 2/2003 | Barton et al. | 416/193 A |
| 7,857,582 | B2 * | 12/2010 | Kovac et al. | 415/173.7 |

FOREIGN PATENT DOCUMENTS

| | | |
|---|---|---|
| EP | 0 926 314 A1 | 6/1999 |
| GB | 780382 A | 7/1957 |
| JP | A-2003-343206 | 12/2003 |

* cited by examiner

*Primary Examiner* — Justine R Yu
*Assistant Examiner* — Ryan H Ellis
(74) *Attorney, Agent, or Firm* — Oliff & Berridge, PLC

(57) ABSTRACT

A compressor of a gas turbine engine comprises blades 2, 4 provided on blade platforms 8, 12 of a rotor. Stator vanes 20 lie between the blades 2, 4 and are connected to a vane support structure 22. Sealing rings 38 are secured to the vane support structure 22 to restrict air flow into stator wells 36 on each side of the vane support structure 22. The sealing rings 38 are made from a flexible material so that they deflect on installation of the vane support structure 22 in a direction radially inwards between the adjacent blade platforms 8, 12.

9 Claims, 2 Drawing Sheets

SEALING ARRANGEMENT IN A GAS TURBINE ENGINE

This invention relates to a sealing arrangement between a stator assembly and a rotor of a gas turbine engine.

In, for example, an axial-flow compressor of a gas turbine engine, blades of a rotor alternate axially with stator vanes which are fixed to the casing of the engine. At their radially inner ends, the rotor blades of each circumferential array are supported on a blade platform. The inner ends of the stator vanes are connected to a support structure which, like the blade platforms, provides a circumferentially extending surface centred on the axis of the engine. There is a gap between the support structure of each row of stator vanes and the adjacent blade platform. In operation, unless measures are taken to prevent it, air from the main air flow path through the compressor can flow through the gaps into stator wells defined beneath the blade platforms and on either side of the vane support structures. This recirculating air in the stator wells reduces the efficiency of the compressor and generates heat.

It is known for labyrinth seals to be provided on rings which are formed integrally with, and project radially from, the rotor, to form a seal against a surface of the vane structure beneath the vane. A disadvantage of this arrangement is that the rotor is an expensive component, and repair can be costly if the labyrinth seal becomes damaged. Furthermore, the projecting rings add weight to the rotor.

GB 780382 discloses an axial-flow compressor for a gas turbine engine in which stator vanes are formed integrally at their inner ends with a support structure in the form of a shroud. The shrouds are provided with integral sealing rings which extend axially beneath flanges of the blade platforms to restrict the recirculation of air beneath the vane shrouds.

It is common for casings of gas turbine engines, and particularly casing parts to which stator vanes are attached, to be horizontally split to form two stator casing halves. When assembling the compressor, the rotor is built up from a plurality of rotor discs carrying the rotor blades, and subsequently the stator halves, with the stator vanes attached, are assembled around the built-up rotor. In this assembly process, the stator vanes are moved into the spaces between the rotor blades. Such an assembly process is not possible if the vane support structure at the inner ends of the vanes has an overall axial width greater than the distance between adjacent axial ends of the blade platforms on the rotors. Consequently, a sealing structure as disclosed in GB 780382 cannot be assembled by displacing the vane support structure radially inwardly between adjacent blade platforms if the sealing rings are effectively rigid, as they would be if they are integral with the vane support structure or inner shrouds, and consequently made from a metal alloy.

According to the present invention there is provided a sealing arrangement between a stator assembly and a rotor of a gas turbine engine, the rotor being rotatable about an engine axis, the stator assembly comprising vanes mounted at their radially inner ends on a vane support structure, and the rotor comprising blades mounted at their radially inner ends on a blade platform, the sealing arrangement comprising a sealing ring fixed to the vane support structure and extending around the engine axis, the sealing ring projecting axially from the support structure to a position axially beyond a circumferential edge of the blade platform and radially inwards of the blade platform, characterised in that the sealing ring is flexible so as to be capable of deflecting over the blade platform during installation of the vane support structure in a radially inwards direction relative to the blade platform.

The vane structure may comprise a plurality of arcuate sections each carrying at least one vane. In an embodiment in accordance with the present invention, the vane structure may comprise two sections, each extending over 180° around the engine axis.

The rotor may comprise two axially spaced blade platforms, and the sealing arrangement may comprise sealing rings on opposite sides of the vane support structure, the axial dimension of the vane support structure between the tips of the sealing rings being greater than the axial distance between the blade platforms.

The sealing ring may be made from a variety of materials which have the required flexibility. By way of example, the sealing rings may be made from an elastomeric material such as rubber or a rubber-based material, or a fluoro elastomer or silicone or from a sufficiently flexible metal or composite. The sealing ring may incorporate a reinforcement, for example a metal alloy or other material having a greater rigidity than the bulk material of the sealing ring. The reinforcement may be sufficiently flexible so as to deflect during installation of the vane support structure, or alternatively may be confined to a region of the sealing ring which does not directly contact the blade platform during installation, so that the reinforcement does not need to deflect during installation.

The vane support structure may be made from any suitable material, for example a metal or metal alloy or a composite material, and the sealing ring may be secured to the vane support structure by any appropriate means, for example adhesive bonding, fasteners such as rivets, screws or bolts, or, if the vane support structure is made from a composite material, by a co-curing process.

The sealing ring may comprise a plurality of arcuate segments which are secured individually to the vane support structure. Each segment may extend, for example over an angle of 20°. This measure reduces the likelihood or severity of damage to engine components should a sealing ring segment become detached.

In a preferred embodiment, the stator assembly and the rotor are components of an axial-flow compressor of the gas turbine engine.

For a better understanding of the present invention, and to show more clearly how it may be carried into effect, reference will now be made, by way of example, to the accompanying drawings, in which:—

Figure 1:
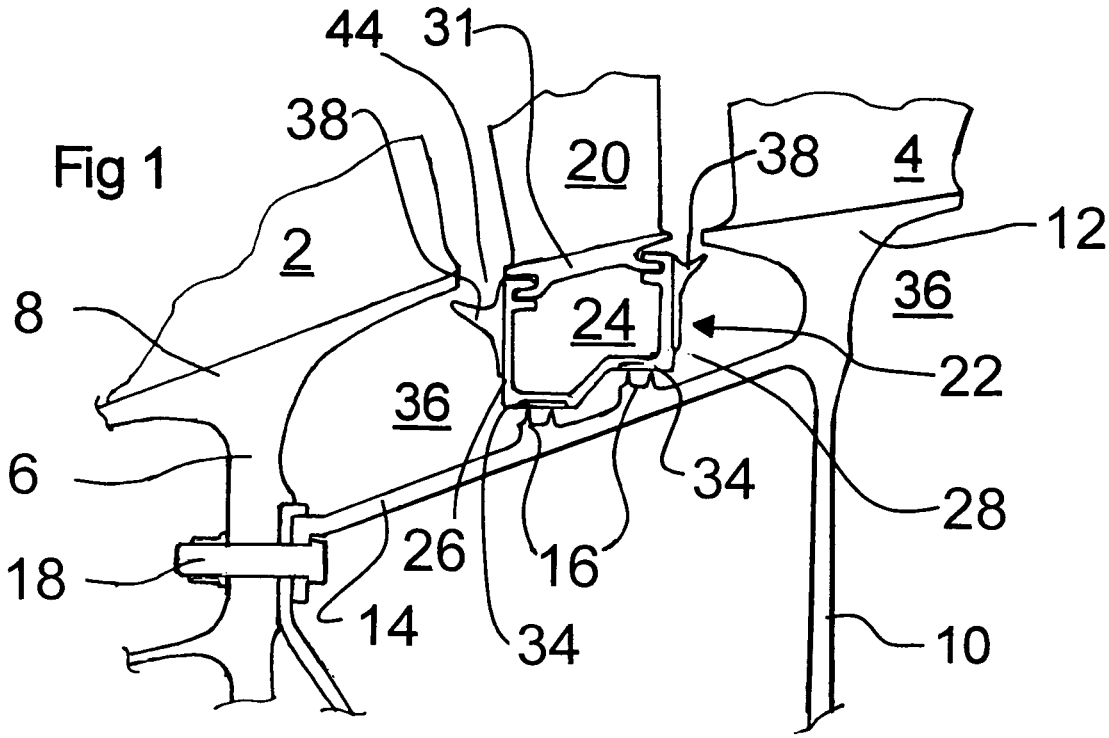
FIG. 1 is a fragmentary sectional view of part of an axial-flow compressor of a gas turbine engine.

FIG. 1 shows blades 2, 4 of successive stages of the compressor. The blades 2 are formed integrally with a rotor disc 6. The radially outer periphery of the disc 6 is axially widened to form a blade platform 8 from which the blades 2 project.

Figure 2:
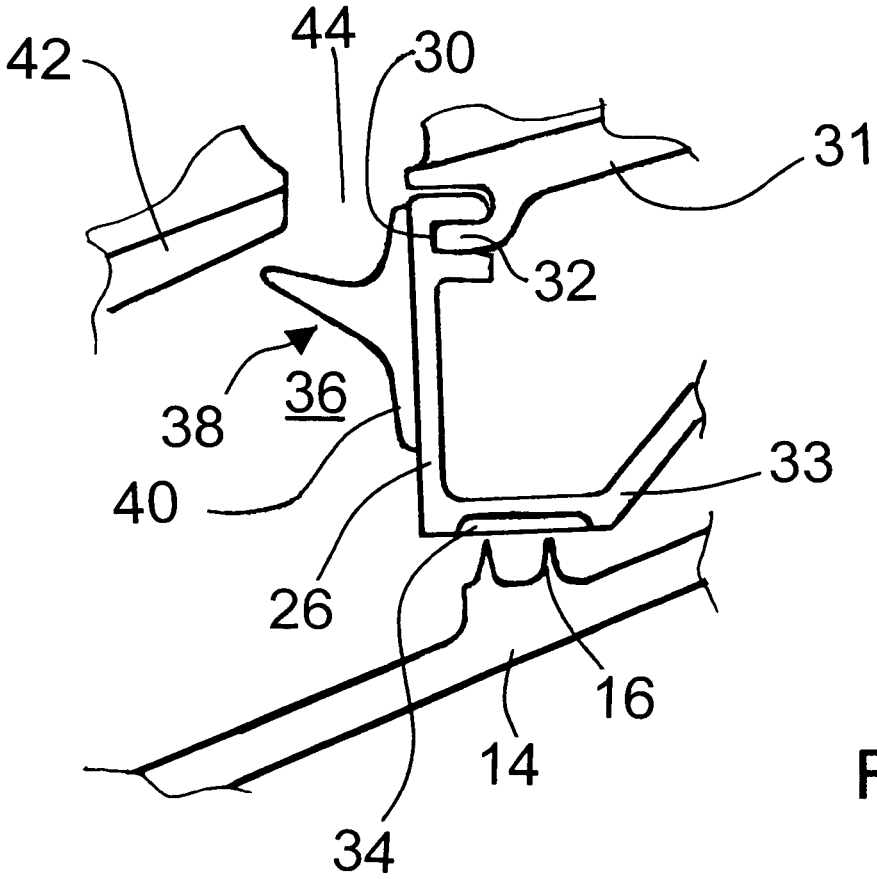
FIG. 2 shows part of FIG. 1 on an enlarged scale.

In a similar fashion, the blades 4, which are downstream of the blades 2 in the direction of air flow through the compressor, is integral with a rotor disc 10 which has a blade platform 12 at its radially outer periphery. The disc 10 has a conical extension 14 provided with labyrinth sealing edges 16. The extension 14 is secured to the upstream disc 6 by fasteners 18. The discs 6 and 10 and their attached blades 2 and 4 thus rotate as one about the engine axis, which is positioned below the part of the compressor seen in FIG. 1. Although FIGS. 1 and 2 show an embodiment in which the respective blades and discs 2, 6; 4, 10 are formed integrally with one another, other structures are possible, for example, in which the blades 2, 4 are formed separately from the discs 6, 8.

A circumferential array of stator vanes 20 is situated between the blades 2, 4. The vanes 20 are secured to the outer casing (not shown) of the compressor and, at their radially inner ends, are connected to a vane support structure 22.

The outer casing and the vane support structure 22 may be circumferentially continuous, the casing then being referred to as a "ring casing". With this construction, the compressor may be assembled by building up successive rotor discs 6, 10 alternately with the stator vanes 20. Thus, for example, the stator vanes 20, with the outer casing and the vane support structure 22, would be installed over the extension 14 in the axial direction towards the right as seen in FIG. 1, and subsequently the disc 6 would be secured to the extension 14 by the fasteners 18.

In other embodiments, however, the outer casing is a split casing, usually in two halves which adjoin each other at a horizontal plane. With such a construction, the vane support structure 22 is similarly split into two halves, and half of the total number of vanes 20 extend between each casing half and the respective support structure half, to constitute a stator half. During assembly of the compressor, each stator half is inserted radially, but in opposite directions, between adjacent blades 2, 4 of a previously fully built-up rotor comprising the discs 6, 10 and similar discs of other compressor stages. This assembly is exemplified in FIG. 3 by reference to an arrow 23.

Although a split casing structure commonly comprises two stator halves, it is possible for the stator to be split into more than two parts.

The vane support structure 22 may thus comprise two or more arcuate sections which together form a ring having a radially outwardly directed channel 24. Side walls 26, 28 of the channel 24 have arcuate slots 30 which receive flanges 32 provided on a shroud 31 at the radially inner ends of the vanes 20.

The base 33 of the channel 24 is provided with abradable linings 34 for cooperation with the labyrinth sealing edges 16 in operation of the engine to provide a seal between opposite axial sides of the vane support structure 22.

As can be appreciated from FIG. 1, the extension 14 and the vane platforms 8, 12 define with the vane support structure 22 a pair of stator wells 36 on opposite sides of the vane support structure 22. In operation of the engine, it is desirable to restrict the flow of air into the stator wells 36 from the main air flow through the compressor over the blades 2, 4 and the vanes 20. For this purpose, a sealing arrangement is provided which comprises sealing rings 38 which are fixed to the side walls 26, 28 of the vane support structure 22. Each sealing ring may be circumferentially continuous over the entire extent of the vane support structure 22 or each section of the vane support structure 22. Alternatively, the sealing ring may comprise a plurality of arcuate sections, for example each extending over an arc of 20° so that, where the vane support structure 22 comprises two halves, there are nine sections of each sealing ring 38 on each side of each half of the vane support structure 22.

Each sealing ring 38 comprises a relatively wide (in the radial direction) base 40 and a projecting lip 42. The lip 42 projects from the side wall 26 in a direction which is inclined to the engine axis in a radially outwards direction away from the base 40. The tip of the lip 42 lies close to the inner surface of the blade platform 8. The lip 42 thus projects from the side wall 26 to a position beyond the axial end of the blade platform 8. The sealing ring 38 on the other side of the vane support structure 22, as shown in FIG. 1, has a similar structure and disposition, although it is of a somewhat smaller size.

Each sealing ring 38 thus restricts the flow of air through the gap 44 between the blade platform 8 and the shroud 31 of the vanes 20. This restricts the circulation of air within the stator well 36, so avoiding loss of efficiency and the transmission of heat.

Figure 3:
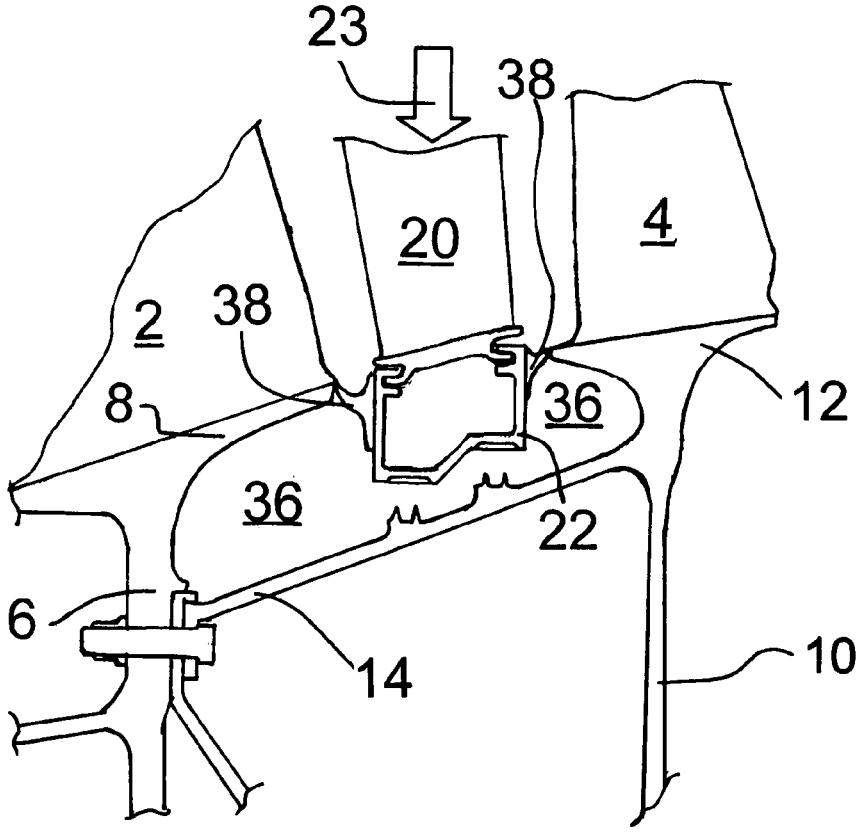
FIG. 3 is similar to FIG. 1 but shows a step during assembly of the compressor.

It will be appreciated from FIG. 1 that the distance between the tips of the sealing rings 38 on opposite sides of the vane support structure 22 is greater than the distance between the closest points of the blade platforms 8, 12. Consequently, it is possible to pass the vane support structure 22 with the sealing rings 38 between the blade platforms 8, 12 only if the sealing rings 38 can deflect. For this purpose, the sealing rings 38 are made from a material which is sufficiently flexible to enable them, or at least the lips 42, to deflect over the blade platforms 8, 12 as the stator assembly is installed. This is shown in FIG. 3, in which the stator assembly comprising the vane 20 and the vane support structure 22 is shown just before the lips 42 of the sealing rings 38 have passed beyond the blade platforms 8, 12, at which point they return to their unstressed configuration, as shown in FIG. 1.

The material from which the sealing rings 38 are made can be any material having the required flexibility as well as the properties required to resist conditions in a compressor stage of a gas turbine engine. Thus, preferred materials are capable of retaining their mechanical properties at temperatures in excess of 200° C. Suitable materials are silicone, elastomers and fluoro elastomers but sufficiently flexible metallic materials may be used, for example in the form of resilient blades. (For example, Viton® is a fluoro elastomer coating material of hexafluoride propylene vinylidene fluoride composition. It has high resistance to many solvents, oils, fuels, and offers heat resistance up to 400° F./~160° C.)

The sealing rings 38 may be secured to the side walls 26, 28 by any suitable means capable of providing a reliable connection at the temperatures encountered in the compressors of gas turbine engines. For example, the sealing rings 38 may be secured to the side walls 26, 28 by a suitable adhesive, or by means of suitable fastening elements. If the vane support structure 22 is made from a plastics material, such as a plastics composite, the sealing rings 38 may be bonded to the side walls 26, 28 by a co-curing process.

Although the present invention has been described in the context of a gas turbine engine compressor having a split casing, sealing rings as described above may also be employed in compressors having ring casings. In such circumstances, the flexibility of the sealing rings 38 is not required to enable the compressor to be assembled, but may nevertheless have advantages in terms of efficient sealing, light weight and ease of manufacture.

In addition, the use of flexible, elastomeric sealing components, particularly if they are made up from separately attached sections, minimises consequential damage in the engine should the sealing elements, or parts of them, become detached and pass into the gas flow path through the engine.

The invention claimed is:

1. A sealing arrangement between a stator assembly and a rotor of a gas turbine engine, the rotor being rotatable about an engine axis, the stator assembly comprising vanes mounted at their radially inner ends on a vane support structure, and the rotor comprising blades mounted at their radially inner ends on a blade platform, the sealing arrangement comprising a sealing ring fixed to the vane support structure and extending around the engine axis, the sealing ring projecting axially from the support structure to a position axially beyond a circumferential edge of the blade platform and radially inwards of the blade platform, wherein the sealing ring is flexible so as to be capable of deflecting over the blade platform during installation of the vane support structure in a direction radially inwards relative to the blade platform.

2. A sealing arrangement as claimed in claim 1, wherein the vane support structure comprises a plurality of arcuate sections each carrying at least one vane.

3. A sealing arrangement as claimed in 2, wherein the rotor comprises two axially spaced blade platforms, the sealing arrangement comprising sealing rings on opposite sides of the vane support structure, the axial dimension of the vane support structure between tips of the sealing rings being greater than the axial distance between adjacent edges of the blade platforms.

4. A sealing arrangement as claimed in claim 1, wherein the material of the or each sealing ring is an elastomer, a silicone elastomer or a fluoro elastomer.

5. A sealing arrangement as claimed in claim 1, wherein the vane support structure is made from a metal, a metal alloy or a composite material.

6. A sealing arrangement as claimed in claim 1, wherein the or each sealing ring is fixed to the vane support structure by means of fastening elements.

7. A sealing arrangement as claimed in claim 1, wherein the or each sealing ring is secured to the vane support structure by bonding to or co-curing with the material of the vane support structure.

8. A sealing arrangement as claimed in claim 1, in which the or each sealing ring comprises a plurality of sealing ring sections which are separately secured to the vane support structure.

9. A sealing arrangement as claimed in claim 1, wherein the stator assembly and the rotor are components of a compressor of a gas turbine engine.

* * * * *